US007681664B2

(12) United States Patent
Patterson et al.

(10) Patent No.: US 7,681,664 B2
(45) Date of Patent: Mar. 23, 2010

(54) INTERNALLY DAMPENED PERCUSSION ROCK DRILL

(76) Inventors: William N. Patterson, P.O. Box 1309, TEI Rock Drills, Inc., Montrose, CO (US) 81402; Glenn R. Patterson, P.O. Box 1309, Montrose, CO (US) 81402

( * ) Notice: Subject to any disclaimer, the term of this patent is extended or adjusted under 35 U.S.C. 154(b) by 0 days.

(21) Appl. No.: 12/150,908

(22) Filed: May 1, 2008

(65) Prior Publication Data

US 2009/0223720 A1 Sep. 10, 2009

Related U.S. Application Data

(60) Provisional application No. 61/034,472, filed on Mar. 6, 2008.

(51) Int. Cl.
*E21B 7/24* (2006.01)
*B25D 9/00* (2006.01)

(52) U.S. Cl. ..... 175/56; 173/207; 173/91; 173/212

(58) Field of Classification Search ..... 175/56, 175/296, 93, 135, 57; 173/116, 134, 135, 173/137, 206, 207, 2, 11, 201; 91/290; 251/1.3
See application file for complete search history.

(56) References Cited

U.S. PATENT DOCUMENTS 2,365,749 A 12/1944 Curtis
2,394,194 A 2/1946 McCarthy
2,814,462 A * 11/1957 De Jarnett ..... 175/320
3,107,738 A 10/1963 Osborn
3,205,951 A 9/1965 Pyles
3,500,941 A 3/1970 Rudman
3,508,619 A 4/1970 Huffman
3,692,124 A 9/1972 Kimber et al.
3,768,576 A 10/1973 Martini
3,896,889 A 7/1975 Bouyoucos (Continued)

FOREIGN PATENT DOCUMENTS

JP 2006512217 4/2006

(Continued)

OTHER PUBLICATIONS

Written Opinion mailed Sep. 25, 2009 in corresponding Application No. PCT/US2009/036312.

(Continued)

*Primary Examiner*—David J Bagnell
*Assistant Examiner*—Yong-Suk Ro
(74) *Attorney, Agent, or Firm*—Gardere Wynne Sewell LLP

(57) ABSTRACT

A percussion drill, and methods of using the same, including a shank in mechanical alignment with a piston-hammer and a valve in fluid communication with the piston-hammer. The percussion drill further includes an internal hydraulic dampening system for reducing the velocity of the piston-hammer when the shank is forward of a power position relative to the velocity of the piston-hammer when the shank is in a power position. Preferably, the internal hydraulic dampening system includes mechanical alignment of a portion of the piston-hammer with a port in fluid communication with the valve, operable to reduce fluid flow into an area surrounding the valve when the piston-hammer is forward of its position relative to its normal operation.

15 Claims, 6 Drawing Sheets

U.S. PATENT DOCUMENTS

| | | | | |
|---|---|---|---|---|
| 3,903,972 | A | 9/1975 | Bouyoucos et al. | |
| 3,917,005 | A | 11/1975 | Cannon et al. | |
| 4,006,783 | A | 2/1977 | Granholm et al. | |
| 4,022,108 | A | 5/1977 | Juvonen et al. | |
| 4,044,844 | A | 8/1977 | Harris et al. | |
| 4,069,877 | A | 1/1978 | Durand | |
| 4,084,486 | A | 4/1978 | Juvonen et al. | |
| 4,150,603 | A | 4/1979 | Etherington et al. | |
| 4,207,805 | A | 6/1980 | Jonsson et al. | |
| 4,474,248 | A | 10/1984 | Musso et al. | |
| 4,478,291 | A | 10/1984 | Futros et al. | |
| 4,563,938 | A | 1/1986 | Henriksson | |
| 4,646,854 | A | 3/1987 | Arndt et al. | |
| 4,660,658 | A | 4/1987 | Gustafsson et al. | |
| 4,784,228 | A * | 11/1988 | Ito | 173/208 |
| 4,828,048 | A | 5/1989 | Mayer et al. | |
| 5,014,796 | A | 5/1991 | Gustafsson et al. | |
| 5,050,688 | A | 9/1991 | Patterson | |
| 5,107,944 | A | 4/1992 | Gustafsson et al. | |
| 5,134,989 | A * | 8/1992 | Akahane | 125/40 |
| 5,396,965 | A | 3/1995 | Hall et al. | |
| 5,445,232 | A | 8/1995 | Brannstrom | |
| 5,680,904 | A | 10/1997 | Patterson | |
| 5,715,897 | A | 2/1998 | Gustafsson et al. | |
| 5,944,117 | A | 8/1999 | Burkholder et al. | |
| 6,047,778 | A | 4/2000 | Coffman et al. | |
| 6,516,902 | B1 | 2/2003 | Klemm | |
| 2001/0013428 | A1 | 8/2001 | Brady | |
| 2004/0094028 | A1 * | 5/2004 | Sheard et al. | 91/394 |
| 2005/0023014 | A1 * | 2/2005 | Bermingham et al. | 173/2 |
| 2006/0175091 | A1 * | 8/2006 | Koskimaki et al. | 175/51 |
| 2007/0246236 | A1 * | 10/2007 | Keskiniva et al. | 173/206 |
| 2007/0267223 | A1 * | 11/2007 | Andersson et al. | 175/296 |
| 2008/0000692 | A1 * | 1/2008 | Roussy | 175/56 |

FOREIGN PATENT DOCUMENTS

| | | |
|---|---|---|
| WO | WO-92/01138 | 1/1992 |

OTHER PUBLICATIONS

International Search Report mailed Sep. 25, 2009 in corresponding Application No. PCT/US2009/036312.

* cited by examiner

INTERNALLY DAMPENED PERCUSSION ROCK DRILL

CROSS-REFERENCE TO RELATED APPLICATIONS

This application claims the benefit of U.S. Provisional Application No. 61/034,472 filed Mar. 6, 2008.

FIELD OF THE INVENTION

The present invention pertains to a pressure fluid actuated reciprocating piston-hammer percussion rock drill including an internal dampening system for reducing the power output of the piston-hammer when the shank is forward of the impact position.

BACKGROUND OF THE INVENTION

In the art of pressure fluid actuated reciprocating piston-hammer percussion rock drills and similar percussion tools, it is known to provide the general configuration of the tool to include a sliding sleeve type valve for distributing pressure fluid to effect reciprocation of a fluid actuated piston-hammer. There are many applications of these types of drills including, for example, drilling holes having a diameter ranging from about 4 centimeters to about 30 centimeters.

Examples of such drills are generally disclosed and claimed in U.S. Pat. No. 5,680,904, issued Oct. 28, 1997. The percussion rock drill disclosed in the '904 patent includes opposed sleeve type valves disposed on opposite reduced diameter end portions of the reciprocating piston-hammer, respectively, for movement with the piston-hammer and for movement relative to the piston-hammer to distribute pressure fluid to opposite sides of the piston-hammer to effect reciprocation of same. Another advantageous design of a fluid actuated percussion rock drill is disclosed and claimed in U.S. Pat. No. 4,828,048 to James R. Mayer and William N. Patterson. The drill described and claimed in the '048 patent utilizes a single sleeve type distributing valve disposed at the fluid inlet end of the drill cylinder.

In such drills the shank may be moved forward, out of its power position, when drilling is no longer required. Such is the situation when the drill is being pulled out of the hole. During this time, however, the sliding sleeve type valve permits the high pressure fluid to continuously drive the piston-hammer. Accordingly, unless impeded, a front landing of the piston-hammer will strike the forward moved shank. Moreover, as the shank is moved forward there is additional length in which the piston-hammer may gain speed. Thus, in some cases the front landing of the piston-hammer strikes the forward moved shank with a force greater than that experienced during operational drilling. Such excessive impact causes components such as the shank to wear unnecessarily. Accordingly, it is desirable to reduce or eliminate such excessive impact. Prior methods of doing so having included the use of shock absorbers, cushions and/or springs to absorb the energy of the piston-hammer. These devices and methods, however, wear themselves and require replacement.

Therefore, what is needed is an improved internal dampening system that is wear resistant.

BRIEF SUMMARY OF THE INVENTION

The present invention provides an improved pressure fluid actuated reciprocating piston-hammer percussion tool, particularly adapted for rock drilling. The invention contemplates, in particular, the provision of an internal dampening system for reducing the velocity of the piston-hammer when the shank is forward of a power position relative to the velocity of the piston-hammer when the shank is in a power position.

In another important aspect of the present invention the piston-hammer includes a front landing, a trip section, and a rear landing; the trip section has a forward shoulder, a center area, and a back shoulder; and the center area is of a lesser diameter than the diameter of the forward shoulder and back shoulder.

In a still further important aspect of the present invention, the fluid communication between the valve and piston-hammer includes at least a first and second port; the internal hydraulic dampening system includes mechanical alignment of the center area and back shoulder of the trip section with the second port to reduce fluid flow into the valve when the piston-hammer is forward of its position relative to its normal operation.

Those skilled in the art will further appreciate the above-mentioned features and advantages of the invention together with other superior aspects thereof upon reading the detailed description which follows in conjunction with the drawing.

BRIEF DESCRIPTION OF THE SEVERAL VIEWS OF THE DRAWINGS

The drawing figures are not necessarily to scale and certain features of the invention may be shown exaggerated in scale or in somewhat schematic form in the interest of clarity and conciseness, wherein.

DETAILED DESCRIPTION OF THE INVENTION

Figure 1:
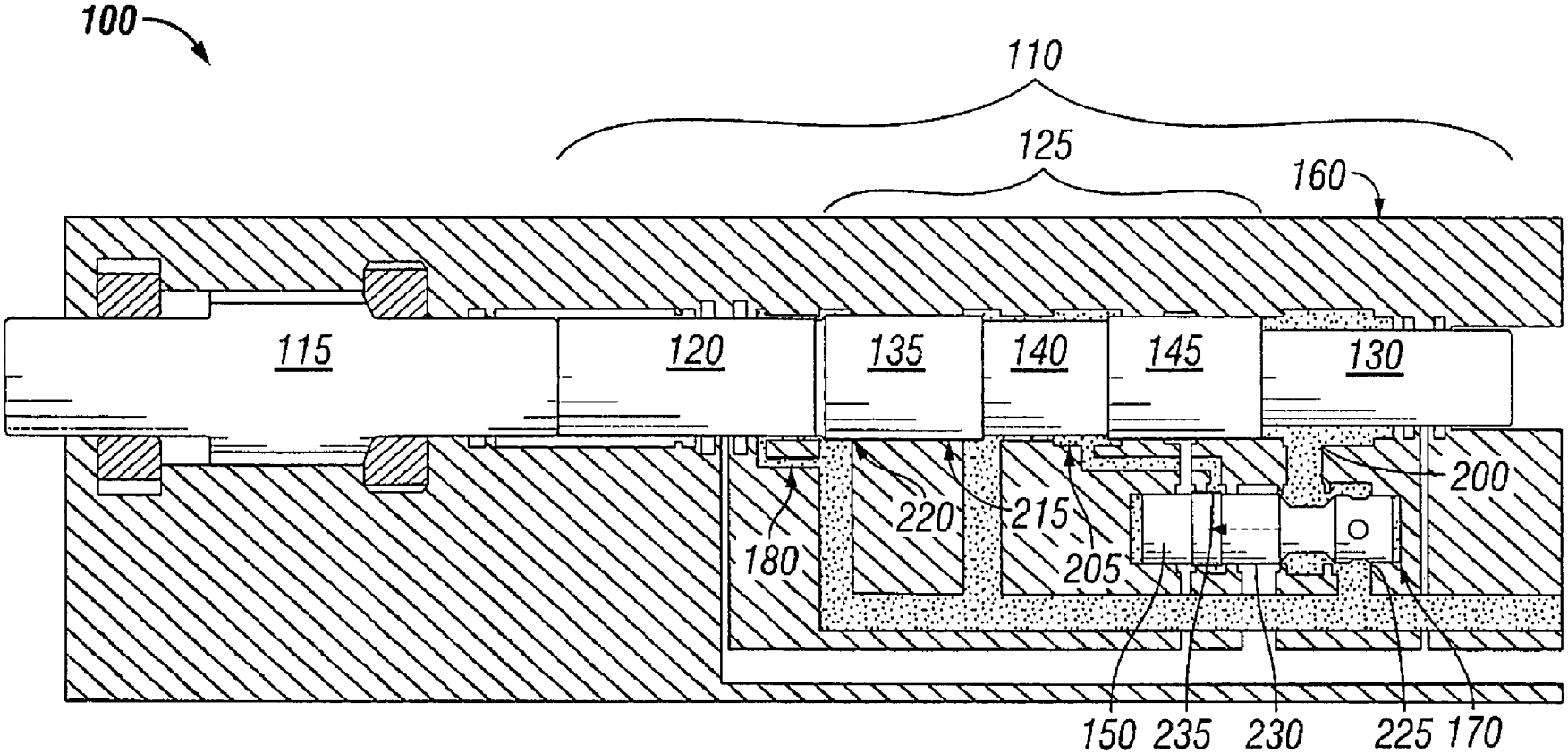
FIG. 1 is a schematic view of a piston-hammer in contact with a shank while the shank is in a power position.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated a schematic of one preferred embodiment of a percussion drill 100. The percussion drill 100 preferably includes a piston-hammer 110 and a shank 115 in mechanical alignment therewith, as well as a valve 150 in fluid communication with the piston-hammer 110. The piston-hammer 110 preferably includes a front landing 120, a trip section 125, and a rear landing 130. And, the trip section 125 itself preferably includes a front shoulder 135 a center area 140 and a back shoulder 145. Preferably, the piston-hammer 110 and its component segments are cylindrical. Preferably, the front shoulder 135 and the back shoulder 145 are of a substantially uniform diameter, and the center area 140 is of a smaller diameter as compared to the front shoulder 135 and back shoulder 145. In an embodiment, the front shoulder 135 and the back shoulder 145 are of a substantially uniform height, and the center area 140 is of a smaller height as compared to the front shoulder 135 and back shoulder 145.

The piston-hammer 110 is disposed within a first housing 160, and the valve 150 is disposed within a second housing 170. The housings may be of any shape. In a preferred embodiment, the first housing 160 has at least a first port 200, a second port 205, a third port 215, and a fourth port 220 and the second housing has at least a fifth port 225, a sixth port 230, and a seventh port 235. The ports serve to allow fluid flow, preferably high pressure fluid, to enter and exit the housings and drive the piston-hammer 110 and valve 150.

The high pressure fluid may be water, oil, glycol, invert emulsions, and the like fluids of at least about 170 atm. In various embodiments, the high pressure fluid may be at least about 68 atm, alternatively at least about 136 atm, alternatively at least about 204 atm, alternatively at least about 272 atm, and alternatively at least about 340 atm. Preferably, the high pressure fluid is hydraulic oil at about 170 atm.

Figure 2:
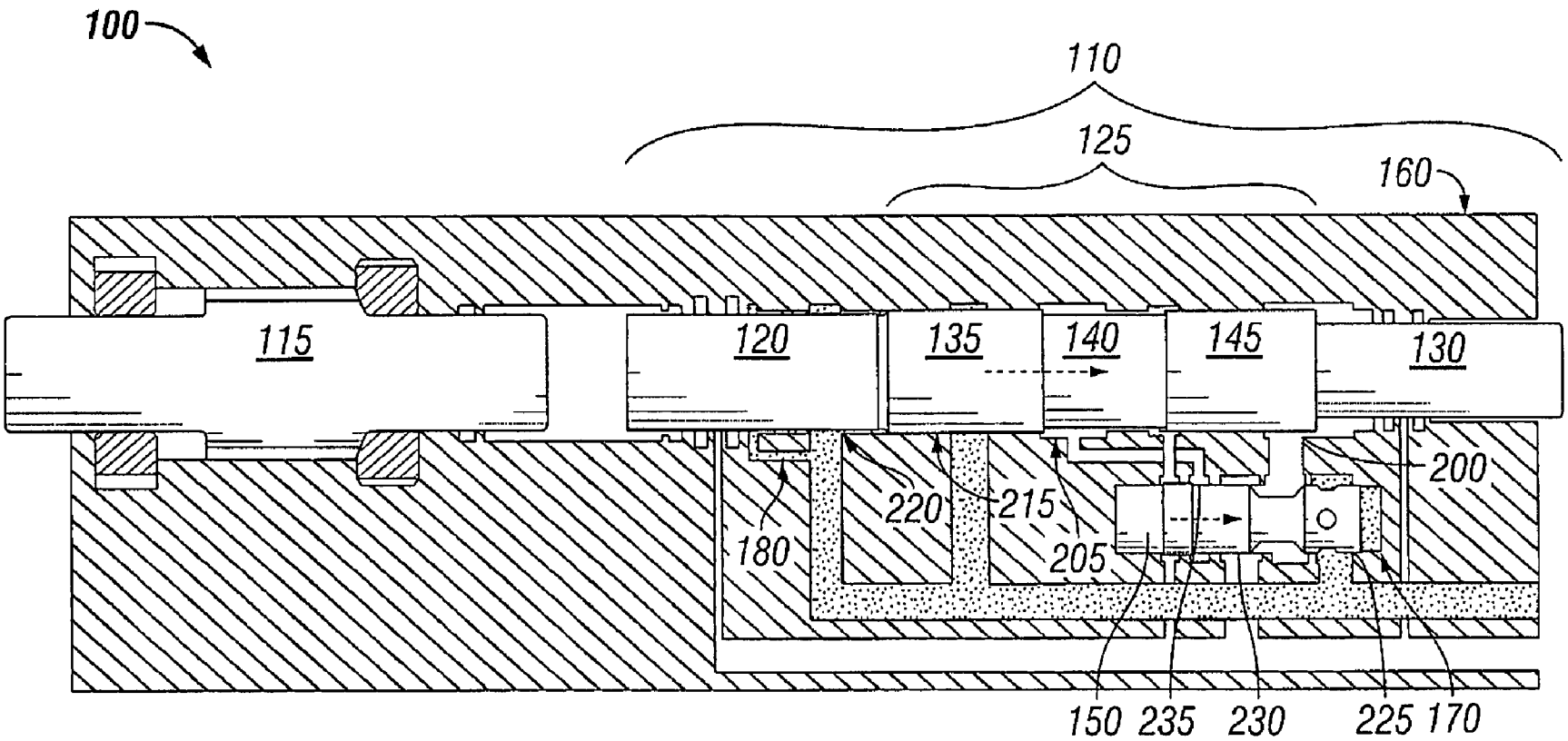
FIG. 2 is a schematic view of the piston-hammer moving away from the shank while the shank is in a power position.
Figure 3:
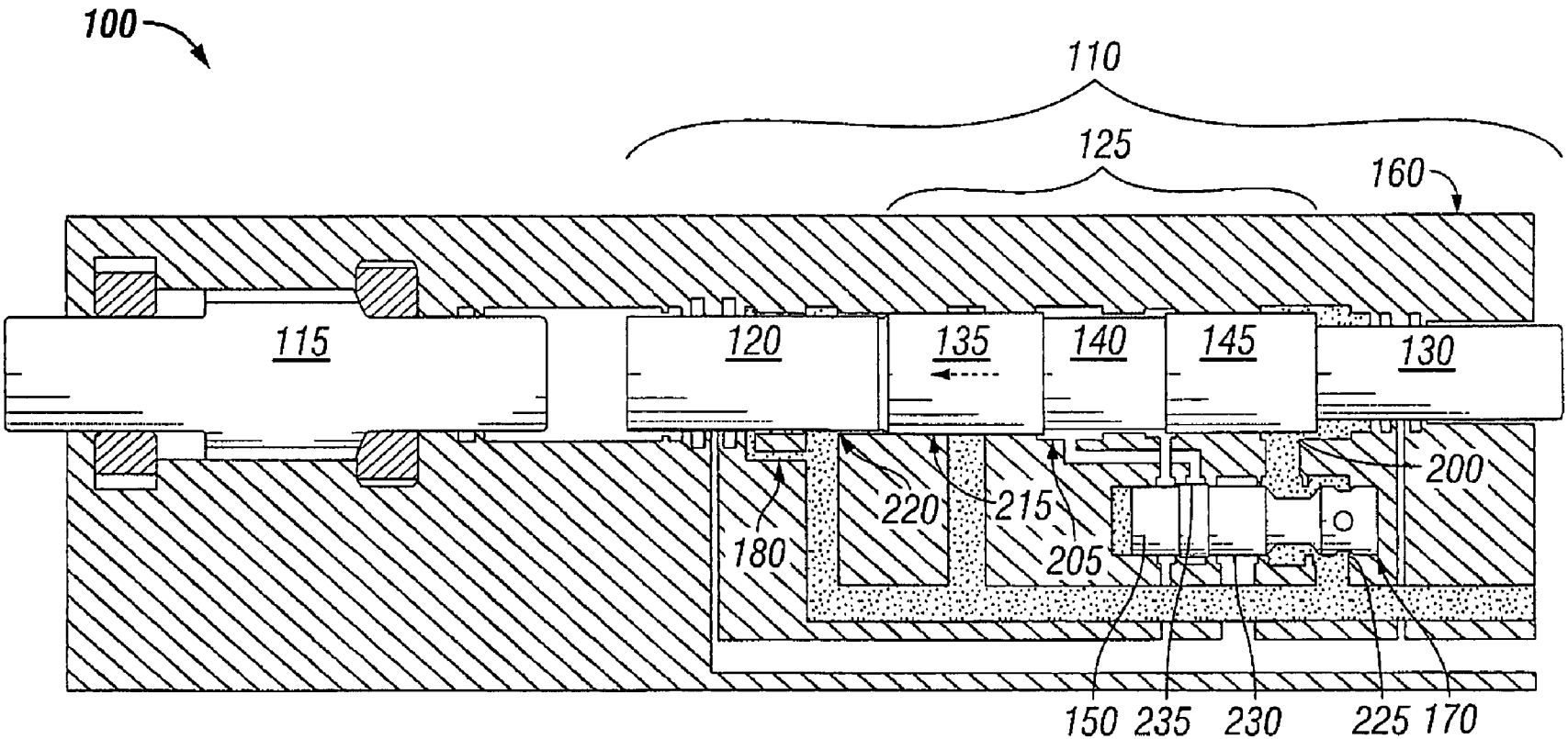
FIG. 3 is a schematic view of the piston-hammer moving toward the shank while the shank is in a power position.
Figure 4:
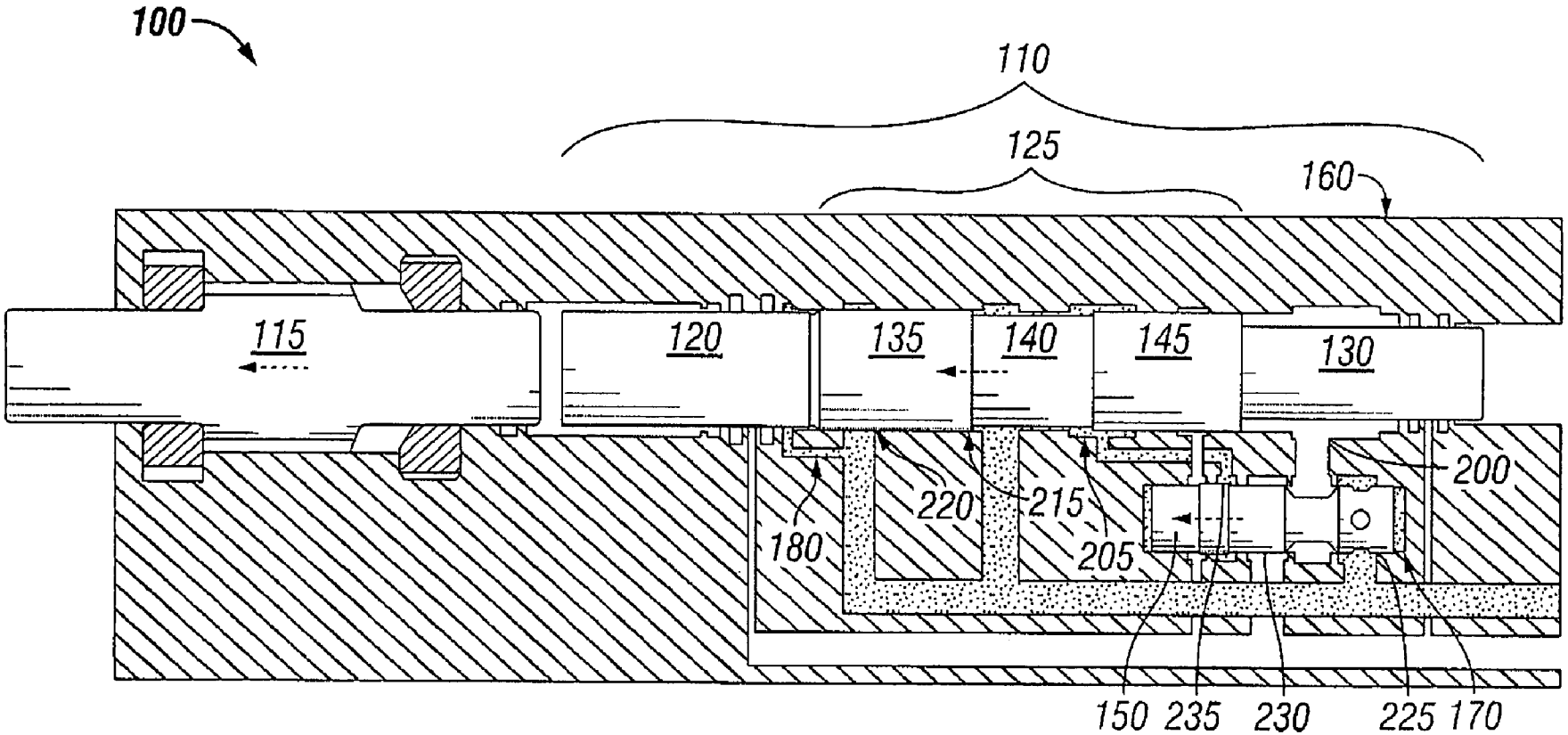
FIG. 4 is a schematic view of the piston-hammer moving toward the shank while the shank is out of a power position.
Figure 5:
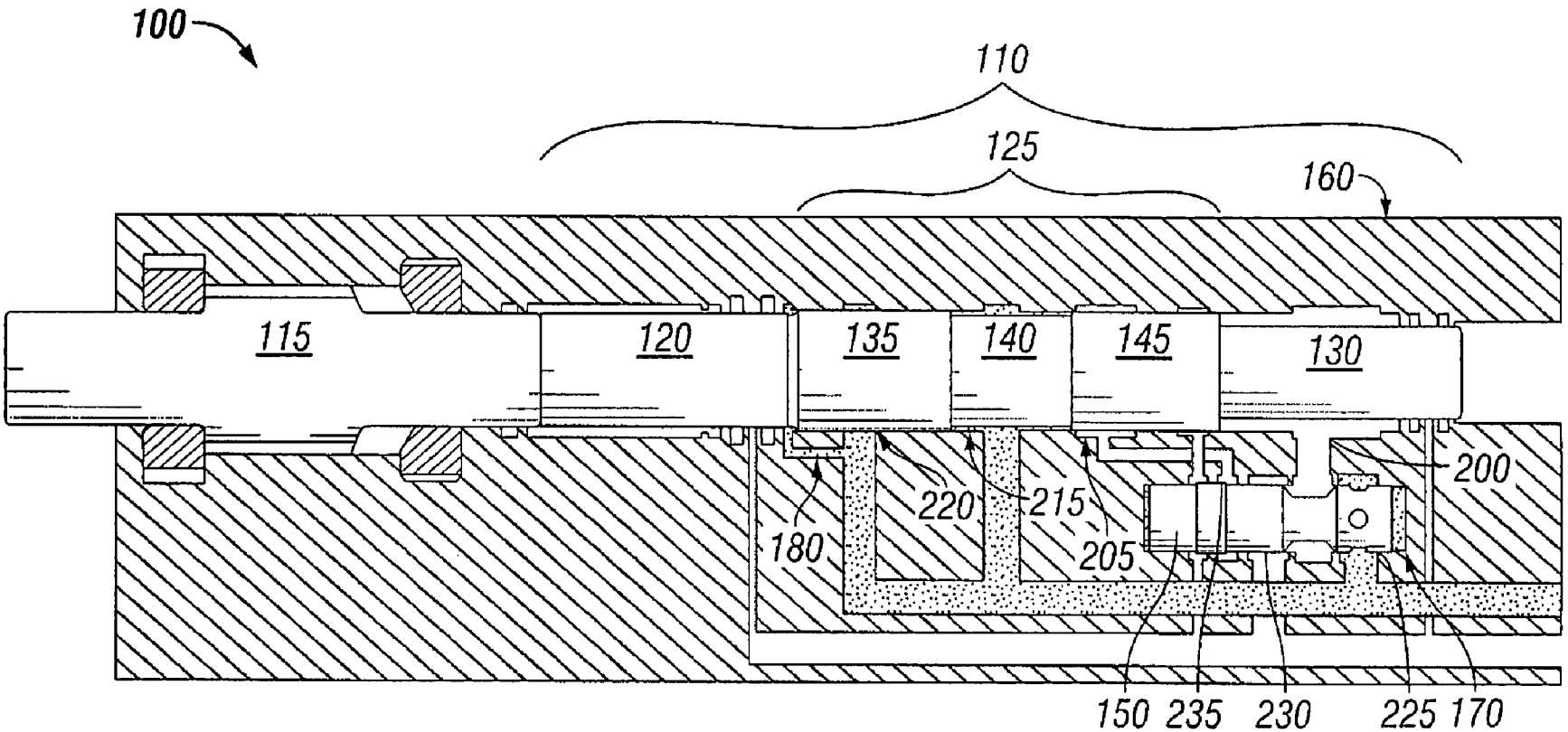
FIG. 5 is a schematic view of the piston-hammer moving at a forward most point while the shank is out of a power position.
Figure 6:
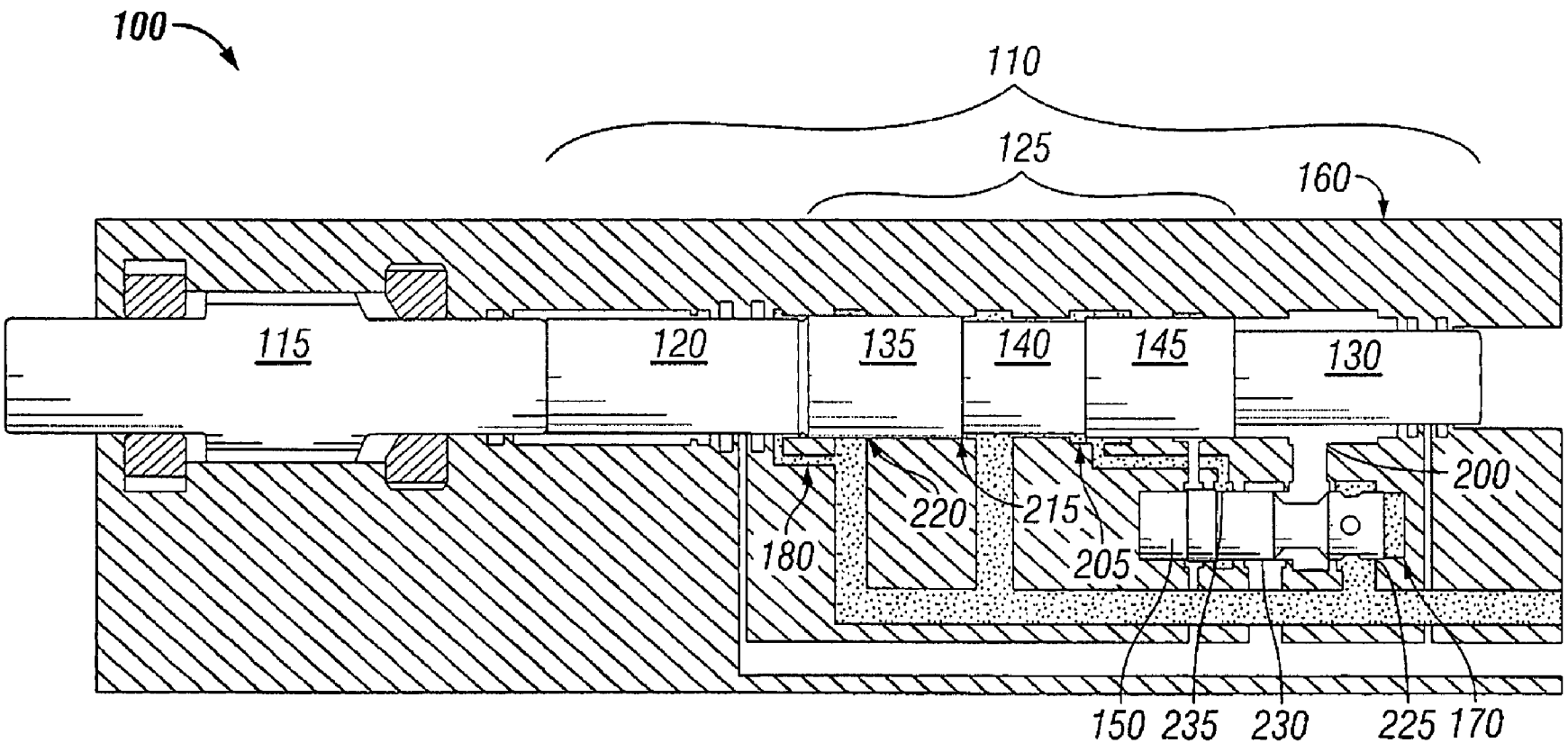
FIG. 6 is a schematic view of the piston-hammer moving and shank in an intermediate position.

FIGS. 1, 2, and 3 illustrate the shank 115 in a normal or power position. FIGS. 4 and 5 illustrate the shank 115 outside of its normal or power position. FIG. 6 illustrates the shank in an intermediate position.

Continuing with reference to FIG. 1, the piston-hammer 110 is at its forward most position and the front landing 120 is in contact with the shank 115. The center area 140 of the trip section 125 bridges the second 205 and third 215 ports allowing fluid to flow into the seventh port 235. The fluid flow into the seventh port 235 increases the pressure differential within the valve 150 and causes it to move in a direction toward the shank 115 within the second housing 170. At the same time, the piston-hammer 110 moves away from the shank 115. As the trip section 125 moves away from the shank 115 the center area 140 no longer bridges the second 205 and third 215 ports, and fluid is cut off from the second port 205.

Referring to FIG. 2, the movement of the valve 150 in a direction away from the shank 115 blocks the fluid flow between the sixth port 230 and the first port 200. The movement of the valve 150 in a direction away from the shank 115 opens the fluid flow between fifth port 225 and the first port 200. This will slow the movement of the piston-hammer 110 until it comes to a stop. Thereafter, the pressure differential within the first housing 160 against the piston-hammer 110 will cause the piston-hammer 110 to move toward from the shank 115, as shown in FIG. 3. In an embodiment, the force differential sufficient to actuate the piston-hammer 110 is at least about 111 newtons, preferably the force differential is at least about 222 newtons. In an embodiment, the force differential sufficient to actuate the piston-hammer 110 is at least about 2.22 kilonewtons.

Referring to FIG. 3, the movement of the valve 150 toward the shank 115 allows fluid to flow into the first port 200. When the pressure differential between the rear landing 130 of the piston-hammer 110 and the front landing 120 of the piston-hammer 110 is great enough, the piston-hammer 110 will move toward the shank 115. The process will then repeat. Preferably, piston-hammer 110 impacts the shank 115 at least 2500 times in one minute.

Referring to FIG. 4, the shank 115 is moved forward, and out of normal striking position, as shown with respect to FIG. 1. In this forward position, however, the back shoulder 145 of the trip section 125 impedes at least a portion of the fluid flow through the second 205 port. The impediment caused by the back shoulder 145 of the trip section 125 preferably decreases the fluid flow into the seventh 235 port an amount sufficient to slow the movement of the valve 150 toward the shank 115. In this embodiment, the valve 150 moves more slowly toward the shank 115 than in power operation. By movement of front shoulder 135 of the trip section 125 into a dash pot 180, i.e., a restricted fluid area, the forward movement of the piston-hammer 110 is slowed.

In an embodiment, the back shoulder 145 causes at least a 10 percent decrease in the fluid flow into the seventh 235 port. In an alternative embodiment, the back shoulder 145 causes at least a 20 percent decrease in the fluid flow into the seventh 235 port. In preferred embodiment, the back shoulder 145 causes at least a 50 percent decrease in the fluid flow into the seventh 235 port. In a still further preferred embodiment, the back shoulder 145 causes at least a 70 percent decrease in the fluid flow into the seventh 235 port.

Referring to FIG. 5, the shank 115 is illustrated forward of power position, and the piston-hammer 110 is in its most forward position. In this manner, the back shoulder 145 of the trip section 125 blocks fluid flow into the second port 205. Thus, no fluid flows into the seventh port 235, and the valve 150 remains in its most rearward position, or is alternatively moved to its most rearward forward position. In either event, in this position the valve 150 permits fluid to flow continuously into the first port 200, and thus the piston-hammer 110 is held in its most forward position.

Preferably, the dash pot 180 contains high pressure fluid in constant fluid communication with the forward landing 120. Thus, the dash pot 180 serves to balance the pressure on the front seal between the front landing 120 and the front shoulder 135 of the trip shoulder 125.

Referring to FIG. 6, the shank 115 is pushed back into power position. Accordingly, the fluid communication between the third port 215 and the second port 205 is opened. Thus, permitting the normal hammer oscillation to resume as described above.

The construction and operation of the drill 100, and associated parts, may be carried out using conventional materials and engineering practices known to those skilled in the art of hydraulic percussion rock drills and the like. Although preferred embodiments of the invention have been described in detail herein, those skilled in the art will recognize that various substitutions and modifications may be made to the invention without departing from the scope and spirit of the appended claims.

What is claimed is:

1. A percussion drill comprising:

a shank movable between a rower position and a position forward of the power position;

a valve in fluid communication in with a piston-hammer, wherein the piston-hammer includes a trio section having a forward shoulder, a center area and a back shoulder, the center area having a smaller diameter than the diameter of the forward and back shoulders forming a high pressure fluid communication path from a third port to a second port; and an internal hydraulic dampening system comprising the back shoulder movable at least partially over the second port and configured to decrease the high pressure fluid flow from the third port into the second port for reducing the fluid flow to the valve in response to the shank being forward of the power position relative to the fluid flow to the valve when the shank is in the power position to thereby slow movement of the valve when the piston-hammer travels forward the power position and thereby reduce the frequency of impact blows when the shank is forward of the rower position.

2. The percussion drill of claim 1, wherein the piston-hammer is disposed within a first housing having at least a first port, the second port, the third, port, a fourth port and the valve is disposed within a second housing having at least a fifth port, a sixth port, and a seventh port; the piston-hammer further including a front landing and a rear landing; and wherein the fluid communication between the valve and piston-hammer includes fluid communication between the ports of the first and second housings.

3. The percussion drill of claim 2, wherein the internal hydraulic dampening system includes mechanical alignment of the center area and back shoulder of the trip section with the second port to reduce fluid flow into the second housing when the piston-hammer is forward of its position relative to its normal operation.

4. A method of internally dampening the piston-hammer of the percussion drill of claim 2, comprising:

a) moving the shank forward, out of power position;

b) aligning the back shoulder with the second port to impede at least a portion of the fluid flow through the second port;

c) reducing fluid flow into the seventh port, slowing the movement of the valve toward the shank; and d) moving the trip section of the piston-hammer into a dash pot, causing the movement of the piston-hammer to slow.

5. The method of claim 4, wherein the dash pot contains high pressure fluid in constant fluid communication with the front landing.

6. The method of claim 4, wherein the impediment caused by the back shoulder causes at least a 20 percent decrease in fluid flow into the seventh port, preferably at least a 70 percent decrease.

7. The method of claim 4, further comprising:

a) moving the back shoulder until it blocks fluid flow into the second port;

b) causing the valve to move to in a direction toward the shank;

c) holding the valve in a position within the second housing;

d) causing continuous fluid flow into the first port; and e) holding the piston-hammer in a position within the first housing.

8. The percussion drill of claim 1, wherein the fluid used in the fluid communication is selected from the group consisting of water, oil, glycol, and invert emulsions, having a pressure of at least about 68 atm.

9. The percussion drill of claim 1, wherein the fluid used in the fluid communication is hydraulic oil having a pressure of about 170 atm.

10. The percussion drill of claim 1, wherein the piston-hammer further includes a front landing and a rear landing; the internal hydraulic dampening system includes mechanical alignment of the center area and back shoulder of the trip section with the second port to reduce fluid flow into the valve when the piston-hammer is forward of its position relative to its normal operation.

11. A method of actuating the piston-hammer of the percussion drill of claim 2, comprising:

a) aligning the center area until it bridges the second and third ports;

b) permitting fluid flow into the seventh port;

c) causing the valve to move in a direction toward the shank within the second housing;

d) increasing the force acting on the piston-hammer until it moves away from the shank; and e) continuing to move the piston-hammer until the forward shoulder blocks fluid flow into the second port.

12. The method of claim 11, further comprising:

a) moving the valve in a direction away from the shank until it blocks fluid flow between the sixth port and the first port;

b) permitting fluid flow between the fifth port and the first port; and c) causing the piston-hammer to stop.

13. The method of claim 12, further comprising:

a) increasing the pressure differential within the first housing against the piston-hammer until the piston-hammer moves toward the shank, wherein the force differential is at least about 111 newtons;

b) moving the valve toward the shank;

c) permitting fluid flow into the first port; and d) moving the piston-hammer toward the shank.

14. The method of claim 13, wherein the steps are repeated at least 2500 times in one minute.

15. A percussion drill comprising:

a shank aligned with a piston-hammer, the shank movable between a power position and a position forward of the power position, wherein the piston hammer and shank are disposed within a first housing having a first port, a second port, a third port and a fourth port and the piston-hammer comprises a front landing, a rear landing and a trip section, the trip section having a center area disposed between a forward shoulder and a back shoulder, the center area having a smaller diameter than the diameter of the forward and back shoulders and disposed within the first housing forming a high pressure fluid path between the third and second ports;

a valve disposed in a second housing, the second housing having a fifth port, a sixth port and a seventh port to facilitate fluid communication with the piston-hammer; and an internal hydraulic dampening system comprising the back shoulder movable over the second port and configured to decrease the high pressure fluid flow from the third port to the seventh port in response to the shank being forward the rower position.

* * * * *

UNITED STATES PATENT AND TRADEMARK OFFICE

CERTIFICATE OF CORRECTION

PATENT NO. : 7,681,664 B2
APPLICATION NO. : 12/150908
DATED : March 23, 2010
INVENTOR(S) : William N. Patterson et al.

It is certified that error appears in the above-identified patent and that said Letters Patent is hereby corrected as shown below:

At column 3, at or about line 66, between the phrases "seventh 235 port" and "an amount sufficient to," please insert the word -- in --.

In the Claims:

Claim 1, line 2, remove the word [rower] and replace with the word -- power --.

Claim 1, line 4, between the phrases "in fluid communication" and "with a piston-hammer," please remove the word [in].

Claim 1, line 19, between the phrases "hammer travels forward" and "the power position," please insert the word -- of --.

Claim 1, line 21, please remove the word [rower] and replace with the word -- power --.

Claim 7, line 4, between the phrases "valve to move" and "in a direction," please remove the word [to].

Claim 15, line 22 (last line), please remove the word [rower] and replace with the word -- power --.

Signed and Sealed this
Third Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,681,664 B2
APPLICATION NO. : 12/150908
DATED : March 23, 2010
INVENTOR(S) : William N. Patterson et al.

It is certified that error appears in the above-identified patent and that said Letters Patent is hereby corrected as shown below:

At column 3, at or about line 66, between the phrases "seventh 235 port" and "an amount sufficient to," please insert the word -- in --.

In the Claims:

Column 4, line 46 (Claim 1, line 2) remove the word [rower] and replace with the word -- power --.

Column 4, line 48 (Claim 1, line 4) between the phrases "in fluid communication" and "with a piston-hammer," please remove the word [in].

Column 4, line 63 (Claim 1, line 19) between the phrases "hammer travels forward" and "the power position," please insert the word -- of --.

Column 4, line 65 (Claim 1, line 21) please remove the word [rower] and replace with the word -- power --.

Column 5, line 36 (Claim 7, line 4) between the phrases "valve to move" and "in a direction," please remove the word [to].

Column 6, line 53 (Claim 15, line 22) (last line), please remove the word [rower] and replace with the word -- power --.

This certificate supersedes the Certificate of Correction issued April 3, 2012.

Signed and Sealed this
First Day of May, 2012

David J. Kappos

David J. Kappos
*Director of the United States Patent and Trademark Office*